United States Patent [19]

Ballentine

[11] 4,090,491

[45] May 23, 1978

[54] CERAMIC GLASS BURNER

[76] Inventor: Earle W. Ballentine, 3641 Via Palomina St., Palos Verdes Estates, Calif. 90274

[21] Appl. No.: 796,425

[22] Filed: May 12, 1977

Related U.S. Application Data

[63] Continuation-in-part of Ser. No. 727,578, Sep. 28, 1976, abandoned, and Ser. No. 696,793, Jun. 16, 1976, which is a continuation-in-part of Ser. No. 654,113, Feb. 2, 1976, abandoned, which is a continuation-in-part of Ser. No. 518,473, Oct. 29, 1974, abandoned, said Ser. No. 727,578, is a continuation-in-part of Ser. No. 687,663, May 19, 1976, abandoned, and Ser. No. 419,514, Nov. 28, 1973, abandoned, which is a continuation-in-part of Ser. No. 376,405, Jul. 5, 1973, abandoned, which is a continuation-in-part of Ser. No. 250,589, May 5, 1972, abandoned, said Ser. No. 687,663, is a continuation-in-part of Ser. No. 610,564, Sep. 4, 1975, abandoned, which is a continuation-in-part of Ser. No. 512,524, Nov. 7, 1974, abandoned, which is a continuation-in-part of Ser. No. 327,148, Jan. 26, 1973, abandoned.

[51] Int. Cl.[2] ..... F24C 3/04

[52] U.S. Cl. ..... 126/39 J; 431/215

[58] Field of Search ..... 126/39 R, 39 J, 299; 431/214, 242, 215; 239/557, 558

[56] References Cited

U.S. PATENT DOCUMENTS

| | | | |
|---|---|---|---|
| 3,285,240 | 11/1966 | Schmidt | 431/215 X |
| 3,525,325 | 8/1970 | Perl | 126/39 J |
| 3,698,378 | 10/1972 | Rosenberg et al. | 126/39 J |
| 3,733,027 | 5/1973 | Napier | 126/39 J |
| 3,968,785 | 7/1976 | Perl | 126/39 J |

*Primary Examiner*—Edward G. Favors
*Attorney, Agent, or Firm*—Ralf H. Siegemund

[57] ABSTRACT

A burner chamber with a flat top is provided with an hexagonal array of specifically spaced apertures through which are discharged free turbulent jets into a mixing chamber in which the fuel gas is mixed by entraining heated air. Combustion occurs above the plane where the jets coalesce and a ceramic top is provided on top of the combustion chamber for heating by combustion products. These hot jets are brought in heat exchange relationship with air flowing into the mixing chamber; radiation from the ceramic top heats the burner chamber.

2 Claims, 6 Drawing Figures

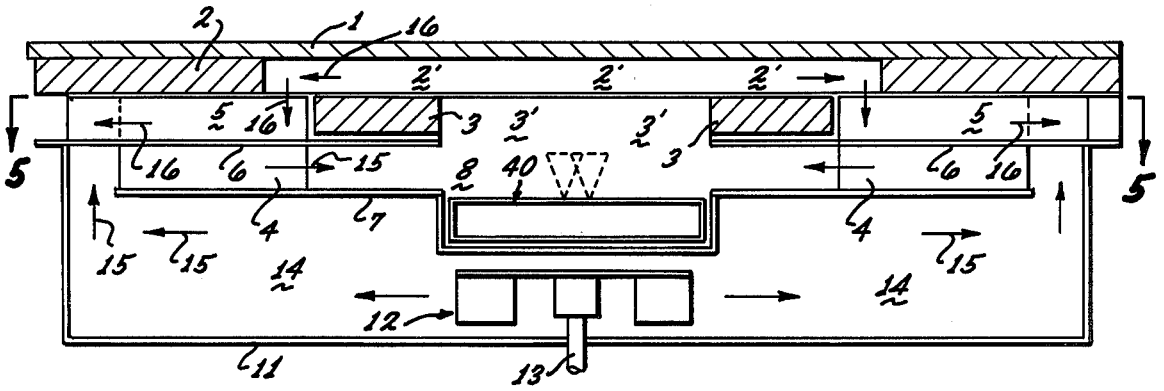
FIG. 1
FIG. 2
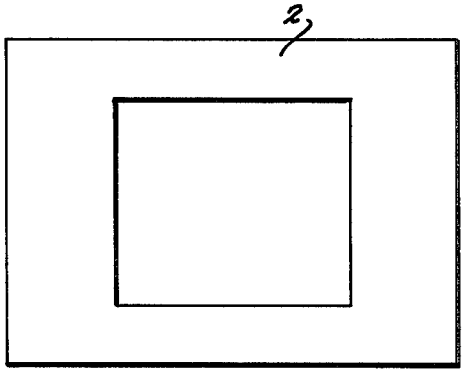
FIG. 3
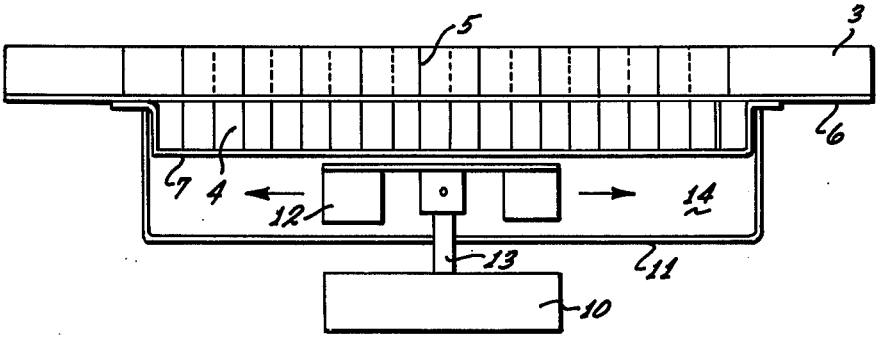

FIG. 4
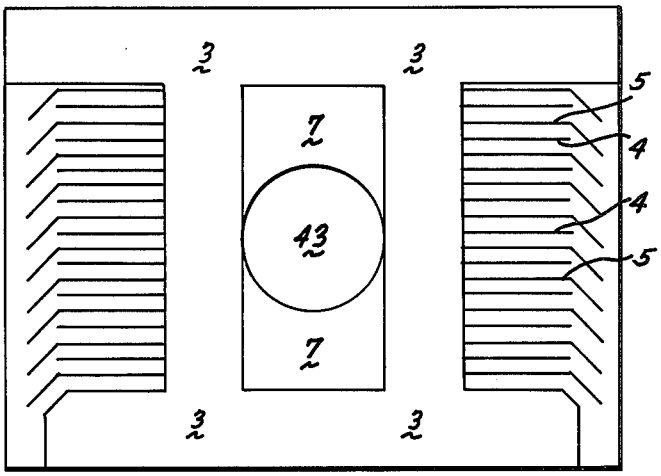
FIG. 5
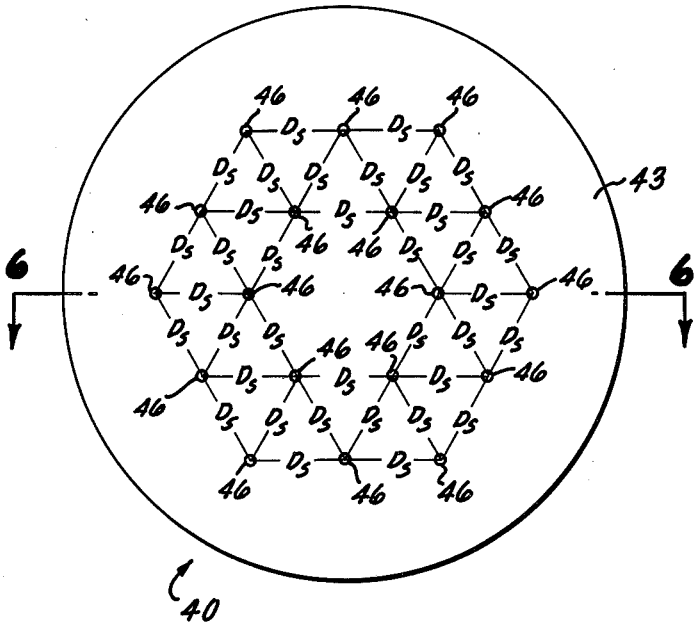
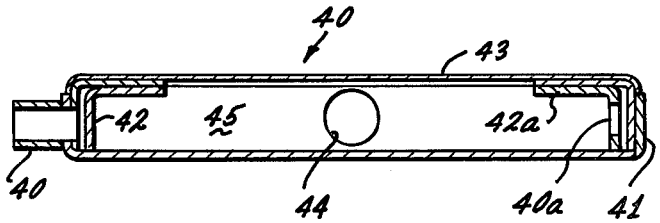
FIG. 6

CERAMIC GLASS BURNER

RELATED APPLICATIONS

This is a continuation in part application of my application Ser. No. 696,793 filed June 16, 1976, and of my application Ser. No. 727,578 filed Sept. 28, 1976 abandoned. The application Ser. No. 696,793 is a continuation in part of my application Ser. No. 654,113, filed Feb. 2, 1976 which, in turn, is continuation in part of my application Ser. No. 518,473 filed Oct. 29, 1974, the latter two applications having been abandoned. Application Ser. No. 727,578 is a continuation in part of applications Ser. No. 419,514 filed Nov. 28, 1973, abandoned and Ser. No. 687,663 filed May 19, 1976 abandoned; Ser. No. 419,514 is a continuation in part of application Ser. No. 376,405 filed July 5, 1973, abandoned, which is a continuation in part of application Ser. No. 250,589 filed May 5, 1972 now abandoned; Ser. No. 687,663 is a continuation in part of my application Ser. No. 610,564 filed Sept. 4, 1975, abandoned which is a continuation in part of my application Ser. No. 512,524 filed Nov. 7, 1974, abandoned, which is a continuation in part of Ser. No. 327,148 filed Jan. 26, 1973, abandoned.

BACKGROUND OF THE INVENTION

The glass-top electric range has experienced wide market acceptance and is destined to become a larger factor in the gas range market, because the housewife has found that it is very easy to clean. There is also a reduced fire hazard. The sales of gas ranges have decreased in the same ratio as marked penetration of the glass-top range sales.

The known gas ranges including those with a ceramic top provide inadequate utilization of the latent energy contained in the fuel gas.

DESCRIPTION OF THE INVENTION

My novel ceramic glass burner includes a stoichiometric burner constructed as burner-absorber-exchanger and has a burner top in which are provided apertures each having a diameter $d_o$, and being arranged in a hexagonal pattern, preferably being arranged in two nested hexagons whereby the apertures are spaced from each other by a linear distance $D_s$ in accordance with the following relationship:

$$D_s > 2.4\ R\ d_o\,[T_{RG}/T_{RA}]$$

wherein R is an air-fuel gas ratio, not smaller than the stoichiometric air-fuel gas ratio (about 10:1 for natural gas) but well below an air diluted air-fuel gas ratio which will stop combustion. In addition, $T_{RG}$ = the Rankine temperature of the gaseous fuel, and $T_{RA}$ = the Rankine temperature of the combustion air. Experimentally I found that at an air-gas ratio of about 15% above the stoichiometric gas ratio, performance, i.e. burning is already very poor. For R below the stoichiometric ratio one obtains incomplete combustion.

Considering these aspects in some detail, fuel gas is discharged through these apertures in free, turbulent jets, whereby air is entrained in the gas to obtain an air-gas mixture. These jets will coalesce at a distance from the burner plate on account of their conical configuration. Optimum results are obtained if at the distance of coalescence the amount of air entrained in the gas jets is such that the air-gas mixture has stoichiometric relation. The relation $D_s/d_o = 2.42\ R\ T_{RG}/T_{RA}$ teaches that for an air-gas ratio R equal to that stoichiometric ratio, the aperture spacing-to-diameter ratio must be so selected. A slightly larger spacing (for a given aperture diameter) produces a higher air content, which still ensures complete combustion but a lower density of heat development. A smaller spacing results in incomplete combustion. Since a very slightly smaller spacing is of little significance, the relation should be $D_s/d_o > 2.4 \times R \times T_{RG}/T_{RA}$, where R is the stoichiometric air-gas ratio. Depending on the gas used, the dilution should not be more than a few percent over the stoichiometric ratio. This corresponds to a spacing $D_s$ being less than about 15% larger than given by the relation $2.42 \times R \times d_o \times T_{RG}/T_{RA}$, wherein R is the true stoichiometric ratio.

The space above the burner's stoichiometric plane of demarcation and jet coalescence, but below the ceramic-glass plate is the combustion chamber wherein the products of combustion have reached their maximum temperature.

The space above the burner but below the plane of demarcation is a mixing chamber wherein the combustion air flows through the lower section of a counterflow recuperator.

The space above the combustion chamber, but below the ceramic-glass plate, includes another heat exchanger, wherein the products of combustion flow in opposite directions along the bottom surface of the ceramic-glass plate and then flow downward into the upper section of the counterflow recuperator. These combustion products transfer their heat to the fins in the lower section of the counterflow recuperator whereby the combustion air is heated by the fins.

The chamber below the counterflow recuperator contains my centrifugal blower which forces the combustion air and subsequently the products of combustion through the lower and upper sections of the two recuperators.

DESCRIPTION OF THE DRAWINGS

While the specification concludes with claims particularly pointing out and distinctly claiming the subject matter which is regarded as the invention, it is believed that the invention, its objects and features, and advantages thereof will be better understood from the following description, which merely illustrates exemplary preferred embodiments of structure which may be utilized to practice the invention, taken in connection with the accompanying drawings, in which:

FIG. 1 is a sectional elevation of the ceramic-glass top burner;

FIG. 2 is a top view of the heat exchange chamber;

FIG. 3 is a sectional side elevation of the ceramic glass top burner;

FIG. 4 is a top view of the combustion chamber which also shows the upper section of a counter flow recuperator;

FIG. 5 is a top view of my circular burner absorber exchanger with hexagonal aperture array or pattern; and FIG. 6 is a cross section through the burner shown in FIG. 5.

Turning first to FIG. 1, reference numeral 1 is the ceramic-glass plate which has a uniform thickness of about 3/16 inch. 2 is the wall of the heat exchange chamber 2' which also supports the ceramic-glass top plate 1. The wall 2 is cemented to the bottom of the ceramic-glass plate 1, and is shown in detail in FIG. 2.

The chamber 2' is supported by an element 3 defining the lower part of a combustion chamber 3', and is shown in detail in FIGS. 2 and 4. The combustion chamber defining element 3 is supported by a plate 6. Plate 6 has an opening which is identical to the bottom opening in element 3. Plate 6 has the same internal peripheral dimensions as the heat exchange chamber 2' as shown in FIG. 2. However, plate 6 also has slots which are identical with fins 4 and fins 5 in FIG. 3. The fins 4 and 5 are supported by a housing 7. The housing 7 also provides a mixing chamber 8 which contains the burner-absorber-exchanger 40 as described in FIGS. 5 and 6.

FIG. 3 is a sectional end view of the ceramic-glass top burner. The fins 4 and 5 are respectively positioned in the discharge path for the combustion products as well as in the input or intake paths for air as it flows towards the mixing chamber 8. The electric motor 10 is supported by the blower housing 11. The supports are not shown. The blower impeller 12 is mounted on the motor shaft 13. The combustion air enters through the fins 4 of the counterflow recuperator along arrows 15. The combustion products leaving the combustion chamber 2' discharge through the fins 4 and fins 5 of the counterflow recuperator and flow along a path 16 to the rear of the range top and then into the room. The combustion air flows radially from the impeller 12 in the plenum 14 as shown by arrows 15. The air enters the fins 4 and flows into the mixing chamber 8, as shown in FIG. 3. The combustion air then flows in the mixing chamber cavity 8 and up into the combustion chamber 3'. The combustion products flow radially out from heat exchange chamber 2' and enter the recuperator fins 4 and 5 as shown by arrows 16. Finally, the combustion products leave the recuperator fins 4 and 5 in 45° change in direction in a quasi-radial flow.

The new burner absorber exchanger 40 is shown in detail in FIGS. 5 and 6; and is made of steel. Gaseous fuel enters coupling 47 and then flows in opposite directions between the outer casing 41 and the exchanger wall 42. The width of the passage between the two walls in 1/16 inches, and that space defines an annular flow path for the fuel gas. The top surface 43 is welded to the outer casing 41. The inner liner 42 is welded to the top surface 43 also. Thus, the gaseous fuel has a long path in the exchanger passages before it enters the chamber 45 through the aperture 40*a* which is located opposite inlet 40.

The gaseous fuel thus flows along the top surface 43 to the orifices 46 from all directions and is thus further heated by the top surface 43 which absorbs the radiation from the ceramic-glass plate 1. The top surface 43 is also coated with colloidal graphite which has a high absorptivity. The tube 44 receives the electric igniter which consists of an igniter resistor which is supported by the porcelain ceramic, which in turn, is supported by the clamp.

The particular unit as shown constitutes a particular example of the above-mentioned three combination unit burner absorber and exchanger. The top surface of the plate 43 is a vigorous absorber of radiation and is used to pre-heat the fuel gas as flowing in the annular space between the flanges 41 and 42. The burner proper is established by two nested linear arrays of apertures 46 each outlining a hexagonal pattern whereby all distances $D_s$ between any aperture and those closest to it pertaining either to the same hexagon or to the respective other hexagon follows the rule outlined above particularly as far as the spacing is concerned. In a typical example, the Rankine temperature of the fuel as so preheated at about 1,185° Rankine and the Rankine temperature of the combustion air after being recuperatively preheated by the combustion gases is about 1,010° so that the Rankine temperature ratio in the formula above is about 1.173. For a diameter $d_o$ of about 16/1,000th of an inch, and a stoichiometric ratio of about 10 the spacing of $D_s$ is equal to a little under half an inch (0.454 inch).

The free jets emanating from the apertures 46 coalesce at a distance from the burner plate 43 which is given by the relation 1.475 $D_s$. This then defines the height of the mixing chamber 8. The combustion chamber 3',2' should be about twice that high.

As far as further construction details is concerned, please refer to the above-identified parent application Ser. No. 696,793, the content of which is incorporated by reference in this application particularly as far as the materials employed is concerned.

The invention is not limited to the embodiments described above but all changes and modifications thereof not constituting departures from the spirit and scope of the invention are intended to be included.

I claim:

1. A gas burner, comprising:

means defining a first chamber having a flat top and an inlet for fuel gas, the fuel gas flowing in contact with an inside wall of the flat top preheating the fuel gas to a Rankine temperature $T_{RG}$;

aperture means in the flat top arranged in a pattern of two nested hexagons wherein the linear spacing between adjacent apertures of the same hexagon as well as the spacing of any aperture from the closest aperture or apertures in the respective other hexagon is equal to 2.4 times R $d_o T_{RG}/T_{RA}$, wherein R is the resulting air-gas ratio being equal to or larger than the stoichiometric air-gas ratio but not larger than about 15% of the stoichiometric air-gas ratio, $d_o$ is the aperture diameter and $T_{RA}$ is the Rankine temperature of combustion air being smaller than $T_{RG}$;

a ceramic glass plate above the first chamber means, and heating said flat top by radiation;

means including the first chamber means and the ceramic glass plate to define a mixing chamber above the flat top, and a combustion chamber above the mixing chamber but underneath the ceramic glass plate; and blower means for forcing air towards the mixing chamber.

2. A gas burner as in claim 1, further including a heat exchanger having a first section and a second section, the first section being in communication with the combustion chamber for receiving heated combustion products therefrom, said second section for receiving ambient air from the blower means, preheating it and discharging the preheated air into said mixing chamber, and at said temperature $T_{RA}$.

* * * * *